US006854533B2

(12) United States Patent
Galloway et al.

(10) Patent No.: US 6,854,533 B2
(45) Date of Patent: Feb. 15, 2005

(54) APPARATUS AND METHOD FOR DRILLING WITH CASING

(75) Inventors: Gregory G. Galloway, Conroe, TX (US); David J. Brunnert, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 46 days.

(21) Appl. No.: 10/325,636

(22) Filed: Dec. 20, 2002

(65) Prior Publication Data

US 2004/0118614 A1 Jun. 24, 2004

(51) Int. Cl.[7] ..... E21B 7/20

(52) U.S. Cl. ..... 175/22; 175/171; 166/380

(58) Field of Search ..... 175/171, 22, 57, 175/257, 262; 166/380; 405/253

(56) References Cited

U.S. PATENT DOCUMENTS

| | | | | |
|---|---|---|---|---|
| 1,842,638 A | 1/1932 | Wigle | | |
| 1,917,135 A | 7/1933 | Littell | | |
| 2,214,429 A | 9/1940 | Miller | ..... | 166/16 |

(List continued on next page.)

FOREIGN PATENT DOCUMENTS

| | | | |
|---|---|---|---|
| EP | 0 571 045 | 8/1998 | ..... E21B/7/06 |
| EP | 1 050 661 | 11/2000 | ..... E21B/7/18 |
| GB | 2 216 926 | 10/1989 | ..... E21B/7/20 |
| GB | 2 357 101 | 6/2001 | ..... E21B/7/06 |
| SU | 1618870 | 1/1991 | ..... E21B/33/14 |
| WO | WO 96/28635 | 9/1996 | ..... E21B/17/14 |
| WO | WO 97/08418 | 3/1997 | ..... E21B/4/18 |
| WO | WO 98/01651 | 1/1998 | ..... E21B/23/00 |
| WO | WO 98/55730 | 12/1998 | ..... E21B/23/00 |
| WO | WO 00/05483 | 2/2000 | ..... E21B/19/16 |
| WO | WO 00/11309 | 3/2000 | ..... E21B/19/16 |
| WO | WO 00/11310 | 3/2000 | ..... E21B/19/16 |
| WO | WO 00/11311 | 3/2000 | ..... E21B/19/16 |
| WO | WO 00/28188 | 5/2000 | ..... E21B/7/06 |
| WO | WO 00/37771 | 6/2000 | ..... E21B/43/10 |
| WO | WO 00/50730 | 8/2000 | ..... E21B/10/66 |
| WO | WO 01/12946 | 2/2001 | ..... E21B/19/00 |
| WO | WO 01/46550 | 6/2001 | ..... E21B/7/20 |
| WO | WO 01/48352 | 7/2001 | ..... E21B/23/00 |
| WO | WO 01/79650 | 10/2001 | ..... E21B/10/60 |
| WO | WO 01/81708 | 11/2001 | ..... E21B/10/32 |
| WO | WO 01/94738 | 12/2001 | ..... E21B/7/20 |
| WO | WO 01/94739 | 12/2001 | ..... E21B/7/20 |
| WO | WO 02/03155 | 1/2002 | ..... G05B/19/4068 |
| WO | WO 02/03156 | 1/2002 | ..... G05B/19/418 |
| WO | WO 02/086287 | 10/2002 | ..... E21B/47/01 |

OTHER PUBLICATIONS

U.K. Search Report, Application No. GB 0329523.5, dated Feb. 25, 2004.

(List continued on next page.)

*Primary Examiner*—David Bagnell
*Assistant Examiner*—Daniel P Stephenson
(74) *Attorney, Agent, or Firm*—Moser, Patterson & Sheridan, L.L.P.

(57) ABSTRACT

The present invention generally relates to a method and an apparatus for drilling with casing. In one aspect, a method of drilling a wellbore with casing is provided, including placing a string of casing with a drill bit at the lower end thereof into a previously formed wellbore and urging the string of casing axially downward to form a new section of wellbore. The method further includes pumping fluid through the string of casing into an annulus formed between the casing string and the new section of wellbore. The method also includes diverting a portion of the fluid into an upper annulus in the previously formed wellbore. In another aspect, a method of drilling with casing to form a wellbore is provided. In yet another aspect, an apparatus for forming a wellbore is provided. In still another aspect, a method of casing a wellbore while drilling the wellbore is provided.

31 Claims, 4 Drawing Sheets

U.S. PATENT DOCUMENTS

| | | | | | |
|---|---|---|---|---|---|
| 2,522,444 | A | | 9/1950 | Grable | 166/16 |
| 2,610,690 | A | | 9/1952 | Beatty | 166/16 |
| 2,621,742 | A | | 12/1952 | Brown | 166/1 |
| 2,641,444 | A | * | 6/1953 | Moon | 166/381 |
| 2,650,314 | A | | 8/1953 | Hennigh et al. | 310/67 |
| 2,668,689 | A | | 2/1954 | Cormany | 255/35 |
| 2,692,059 | A | | 10/1954 | Bolling, Jr. | 214/2.5 |
| 2,738,011 | A | | 3/1956 | Mabry | 166/144 |
| 2,743,495 | A | | 5/1956 | Eklund | 22/202 |
| 2,765,146 | A | | 10/1956 | Williams, Jr. | |
| 2,805,043 | A | | 9/1957 | Williams, Jr. | |
| 3,036,530 | A | | 5/1962 | Mills et al. | 104/155 |
| 3,122,811 | A | | 3/1964 | Gilreath | 24/263 |
| 3,123,160 | A | | 3/1964 | Kammerer | 175/82 |
| 3,159,219 | A | | 12/1964 | Scott | 166/156 |
| 3,169,592 | A | * | 2/1965 | Kammerer | 175/257 |
| 3,380,528 | A | | 4/1968 | Timmons | 166/14 |
| 3,392,609 | A | | 7/1968 | Bartos | 81/57 |
| 3,518,903 | A | | 7/1970 | Ham et al. | 81/57.16 |
| 3,550,684 | A | | 12/1970 | Cubberly, Jr. | 166/250 |
| 3,552,508 | A | | 1/1971 | Brown | 175/258 |
| 3,552,509 | A | | 1/1971 | Brown | 175/258 |
| 3,552,510 | A | | 1/1971 | Brown | 175/261 |
| 3,559,739 | A | | 2/1971 | Hutchison | 166/311 |
| 3,570,598 | A | | 3/1971 | Johnson | 166/178 |
| 3,603,411 | A | | 9/1971 | Link | 175/259 |
| 3,603,412 | A | | 9/1971 | Kammerer, Jr. et al. | 175/260 |
| 3,603,413 | A | | 9/1971 | Grill et al. | 175/261 |
| 3,656,564 | A | | 4/1972 | Brown | 175/228 |
| 3,692,126 | A | | 9/1972 | Rushing et al. | 175/259 |
| 3,729,057 | A | | 4/1973 | Werner | 175/262 |
| 3,747,675 | A | | 7/1973 | Brown | 166/237 |
| 3,808,916 | A | | 5/1974 | Porter et al. | 81/57.19 |
| 3,838,613 | A | | 10/1974 | Wilms | 81/57.34 |
| 3,840,128 | A | | 10/1974 | Swoboda, Jr. et al. | 214/1 |
| 3,870,114 | A | | 3/1975 | Pulk, deceased et al. | 175/258 |
| 3,881,375 | A | | 5/1975 | Kelly | 81/57.35 |
| 3,885,679 | A | | 5/1975 | Swoboda, Jr. et al. | 214/1 |
| 3,933,108 | A | | 1/1976 | Baugh | 114/5 |
| 3,945,444 | A | | 3/1976 | Knudson | 175/92 |
| 3,964,556 | A | | 6/1976 | Gearhart et al. | 175/45 |
| 3,980,143 | A | | 9/1976 | Swartz et al. | 173/100 |
| 4,006,777 | A | | 2/1977 | LaBauve | 166/250 |
| 4,009,561 | A | | 3/1977 | Young | 57/6 |
| 4,049,066 | A | | 9/1977 | Richey | 175/323 |
| 4,054,426 | A | | 10/1977 | White | 51/309 |
| 4,063,602 | A | | 12/1977 | Howell et al. | 175/7 |
| 4,064,939 | A | | 12/1977 | Marquis | 166/253 |
| 4,077,525 | A | | 3/1978 | Callegari et al. | 214/2.5 |
| 4,082,144 | A | | 4/1978 | Marquis | 166/250 |
| 4,085,808 | A | | 4/1978 | Kling | 175/94 |
| 4,100,968 | A | | 7/1978 | Delano | 166/315 |
| 4,100,981 | A | | 7/1978 | Chaffin | |
| 4,113,236 | A | | 9/1978 | Neinast | 254/134.5 |
| 4,116,274 | A | | 9/1978 | Rankin et al. | 166/250 |
| 4,133,396 | A | | 1/1979 | Tschirky | 175/57 |
| 4,142,739 | A | | 3/1979 | Billingsley | 285/18 |
| 4,144,396 | A | | 3/1979 | Okano et al. | 560/246 |
| 4,173,457 | A | | 11/1979 | Smith | 51/309 |
| 4,175,619 | A | | 11/1979 | Davis | 166/291 |
| 4,194,383 | A | | 3/1980 | Huzyak | 72/245 |
| 4,227,197 | A | | 10/1980 | Nimmo et al. | 343/878 |
| 4,256,146 | A | | 3/1981 | Genini et al. | 138/111 |
| 4,257,442 | A | | 3/1981 | Claycomb | 137/238 |
| 4,262,693 | A | | 4/1981 | Giebeler | 137/494 |
| 4,274,777 | A | | 6/1981 | Scaggs | 414/22 |
| 4,281,722 | A | | 8/1981 | Tucker et al. | 175/57 |
| 4,287,949 | A | | 9/1981 | Lindsey, Jr. | 166/212 |
| 4,291,772 | A | | 9/1981 | Beynet | 175/5 |
| 4,315,553 | A | | 2/1982 | Stallings | 175/207 |
| 4,320,915 | A | | 3/1982 | Abbott et al. | 294/96 |
| 4,336,415 | A | | 6/1982 | Walling | 174/47 |
| 4,384,627 | A | | 5/1983 | Ramirez-Jauregui | 175/260 |
| 4,408,669 | A | | 10/1983 | Wiredal | 175/258 |
| 4,413,682 | A | | 11/1983 | Callihan et al. | 166/382 |
| 4,430,892 | A | | 2/1984 | Owings | 73/151 |
| 4,440,220 | A | | 4/1984 | McArthur | 166/85 |
| 4,460,053 | A | | 7/1984 | Jurgens et al. | 175/329 |
| 4,463,814 | A | | 8/1984 | Horstmeyer et al. | 175/45 |
| 4,470,470 | A | | 9/1984 | Takano | 175/260 |
| 4,472,002 | A | | 9/1984 | Beney et al. | 308/3.9 |
| 4,474,243 | A | | 10/1984 | Gaines | 166/362 |
| 4,534,426 | A | | 8/1985 | Hooper | 175/65 |
| 4,544,041 | A | * | 10/1985 | Rinaldi | 175/57 |
| 4,545,443 | A | | 10/1985 | Wiredal | 175/258 |
| 4,580,631 | A | | 4/1986 | Baugh | 166/208 |
| 4,583,603 | A | | 4/1986 | Dorleans et al. | 175/324 |
| 4,589,495 | A | | 5/1986 | Langer et al. | 166/383 |
| 4,604,724 | A | | 8/1986 | Shaginian et al. | 364/478 |
| 4,605,077 | A | | 8/1986 | Boyadjieff | 175/85 |
| 4,630,691 | A | | 12/1986 | Hooper | 175/65 |
| 4,651,837 | A | | 3/1987 | Mayfield | 175/262 |
| 4,652,195 | A | | 3/1987 | McArthur | 414/22 |
| 4,655,286 | A | | 4/1987 | Wood | 166/285 |
| 4,671,358 | A | | 6/1987 | Lindsey, Jr. et al. | 166/291 |
| 4,676,310 | A | | 6/1987 | Scherbatskoy et al. | 166/65.1 |
| 4,686,873 | A | | 8/1987 | Lang et al. | 81/57.35 |
| 4,691,587 | A | | 9/1987 | Farrand et al. | 74/493 |
| 4,725,179 | A | | 2/1988 | Woolslayer et al. | 414/22 |
| 4,735,270 | A | | 4/1988 | Fenyvesi | 175/113 |
| 4,760,882 | A | | 8/1988 | Novak | 166/295 |
| 4,762,187 | A | | 8/1988 | Haney | 175/71 |
| 4,765,416 | A | | 8/1988 | Bjerking et al. | 175/71 |
| 4,813,495 | A | | 3/1989 | Leach | 175/6 |
| 4,832,552 | A | | 5/1989 | Skelly | 414/22.54 |
| 4,840,128 | A | | 6/1989 | McFarlane et al. | 108/50 |
| 4,842,081 | A | | 6/1989 | Parant | 175/23 |
| 4,843,945 | A | | 7/1989 | Dinsdale | 81/57.34 |
| 4,854,386 | A | | 8/1989 | Baker et al. | 166/289 |
| 4,880,058 | A | | 11/1989 | Lindsey et al. | 166/289 |
| 4,883,125 | A | | 11/1989 | Wilson et al. | 166/291 |
| 4,909,741 | A | | 3/1990 | Schasteen et al. | 439/13 |
| 4,921,386 | A | | 5/1990 | McArthur | 414/22.51 |
| 4,962,822 | A | | 10/1990 | Pascale | 175/258 |
| 4,997,042 | A | | 3/1991 | Jordan et al. | 166/379 |
| 5,009,265 | A | | 4/1991 | Bailey et al. | 166/118 |
| 5,022,472 | A | | 6/1991 | Bailey et al. | 175/195 |
| 5,027,914 | A | | 7/1991 | Wilson | 175/406 |
| 5,049,020 | A | | 9/1991 | McArthur | 414/22.51 |
| 5,060,542 | A | | 10/1991 | Hauk | 81/57.34 |
| 5,060,737 | A | | 10/1991 | Mohn | 175/104 |
| 5,069,297 | A | | 12/1991 | Krueger, deceased et al. | 175/65 |
| 5,074,366 | A | | 12/1991 | Karlsson et al. | 175/76 |
| 5,082,069 | A | | 1/1992 | Seiler et al. | 175/5 |
| 5,096,465 | A | | 3/1992 | Chen et al. | 51/295 |
| 5,111,893 | A | | 5/1992 | Kvello-Aune | 175/258 |
| 5,148,875 | A | | 9/1992 | Karlsson et al. | 175/62 |
| 5,156,213 | A | | 10/1992 | George et al. | 166/297 |
| 5,160,925 | A | | 11/1992 | Dailey et al. | 340/853.3 |
| 5,168,942 | A | | 12/1992 | Wydrinski | 175/50 |
| 5,172,765 | A | | 12/1992 | Sas-Jaworsky | 166/384 |
| 5,176,180 | A | | 1/1993 | Williams et al. | 138/172 |
| 5,176,518 | A | | 1/1993 | Hordijk et al. | 434/37 |
| 5,186,265 | A | | 2/1993 | Henson et al. | 175/107 |
| 5,191,939 | A | | 3/1993 | Stokley | 166/379 |
| 5,197,553 | A | * | 3/1993 | Leturno | 175/57 |
| 5,209,302 | A | | 5/1993 | Robichaux et al. | 166/355 |
| 5,234,052 | A | | 8/1993 | Coone et al. | 166/155 |
| 5,255,741 | A | | 10/1993 | Alexander | 166/278 |
| 5,255,751 | A | | 10/1993 | Stogner | 175/203 |

5,271,472 A 12/1993 Leturno ..... 175/107
5,282,653 A 2/1994 LaFleur et al. ..... 285/110
5,285,008 A 2/1994 Sas-Jaworsky et al. ..... 174/47
5,285,204 A 2/1994 Sas-Jaworsky ..... 340/854.9
5,291,956 A 3/1994 Mueller et al. ..... 175/67
5,294,228 A 3/1994 Willis et al. ..... 414/22.55
5,297,833 A 3/1994 Willis et al. ..... 294/102.2
5,305,830 A 4/1994 Wittrisch ..... 166/250
5,320,178 A 6/1994 Cornette ..... 175/19
5,323,858 A 6/1994 Jones et al. ..... 166/291
5,332,048 A 7/1994 Underwood et al. ..... 175/26
5,339,899 A 8/1994 Ravi et al. ..... 166/250
5,343,950 A 9/1994 Hale et al. ..... 166/293
5,343,951 A 9/1994 Cowan et al. ..... 166/293
5,353,872 A 10/1994 Wittrisch ..... 166/250
5,354,150 A 10/1994 Canales ..... 405/154
5,355,967 A 10/1994 Mueller et al. ..... 175/65
5,368,113 A 11/1994 Schulze-Beckinghausen ..... 175/162
5,379,835 A 1/1995 Streich ..... 166/181
5,386,746 A 2/1995 Hauk ..... 81/57.34
5,392,715 A 2/1995 Pelrine ..... 104/138.2
5,398,760 A 3/1995 George et al. ..... 166/297
5,412,568 A 5/1995 Schultz ..... 364/422
5,452,923 A 9/1995 Smith ..... 285/145
5,472,057 A * 12/1995 Winfree ..... 175/57
5,497,840 A 3/1996 Hudson ..... 175/72
5,535,824 A 7/1996 Hudson ..... 166/207
5,535,838 A 7/1996 Keshavan et al. ..... 175/374
5,547,029 A 8/1996 Rubbo et al. ..... 166/375
5,547,314 A 8/1996 Ames ..... 405/165
5,551,521 A 9/1996 Vail, III ..... 175/65
5,553,672 A 9/1996 Smith, Jr. et al. ..... 166/382
5,560,437 A 10/1996 Dickel et al. ..... 175/40
5,582,259 A 12/1996 Barr ..... 175/73
5,584,343 A 12/1996 Coone ..... 166/387
5,613,567 A 3/1997 Hudson
5,615,747 A 4/1997 Vail, III ..... 175/379
5,651,420 A 7/1997 Tibbitts et al. ..... 175/102
5,661,888 A 9/1997 Hanslik ..... 29/407.02
5,662,170 A 9/1997 Donovan et al. ..... 166/358
5,662,182 A 9/1997 McLeod et al. ..... 175/258
5,667,011 A 9/1997 Gill et al. ..... 166/295
5,667,023 A 9/1997 Harrell et al. ..... 175/45
5,667,026 A 9/1997 Lorenz et al. ..... 175/162
5,711,382 A 1/1998 Hansen et al. ..... 175/52
5,720,356 A 2/1998 Gardes ..... 175/62
5,732,776 A 3/1998 Tubel et al. ..... 166/250.15
5,735,348 A 4/1998 Hawkins, III ..... 166/285
5,743,344 A 4/1998 McLeod et al. ..... 175/259
5,746,276 A 5/1998 Stuart ..... 173/1
5,769,160 A 6/1998 Owens ..... 166/65.1
5,785,134 A 7/1998 McLeod et al. ..... 175/258
5,794,703 A 8/1998 Newman et al. ..... 166/381
5,804,713 A 9/1998 Kluth ..... 73/152.01
5,828,003 A 10/1998 Thomeer et al. ..... 174/69
5,829,520 A 11/1998 Johnson ..... 166/250.1
5,836,409 A 11/1998 Vail, III ..... 175/379
5,839,330 A 11/1998 Stokka ..... 81/57.33
5,839,519 A 11/1998 Spedale, Jr. ..... 175/57
5,842,149 A 11/1998 Harrell et al. ..... 702/9
5,842,530 A 12/1998 Smith et al. ..... 175/162
5,845,722 A 12/1998 Makohl et al. ..... 175/101
5,860,474 A 1/1999 Stoltz et al. ..... 166/50
5,890,537 A 4/1999 Lavaure et al. ..... 166/285
5,890,549 A 4/1999 Sprehe ..... 175/71
5,894,897 A 4/1999 Vail, III ..... 175/318
5,907,664 A 5/1999 Wang et al. ..... 395/86
5,908,049 A 6/1999 Williams et al. ..... 138/125
5,913,337 A 6/1999 Williams et al. ..... 138/125
5,921,285 A 7/1999 Quigley et al. ..... 138/125
5,921,332 A 7/1999 Spedale, Jr. ..... 175/415
5,931,231 A 8/1999 Mock ..... 166/377
5,947,213 A 9/1999 Angle et al. ..... 175/24
5,950,742 A 9/1999 Caraway ..... 175/57
5,954,131 A 9/1999 Sallwasser ..... 166/254.2
5,957,225 A 9/1999 Sinor ..... 175/57
5,971,079 A 10/1999 Mullins ..... 166/387
6,000,472 A 12/1999 Albright et al. ..... 166/380
6,026,911 A 2/2000 Angle et al. ..... 175/24
6,059,051 A 5/2000 Jewkes et al. ..... 175/76
6,059,053 A 5/2000 McLeod ..... 175/258
6,061,000 A 5/2000 Edwards ..... 340/854.6
6,062,326 A 5/2000 Strong et al. ..... 175/402
6,065,550 A 5/2000 Gardes ..... 175/62
6,082,461 A 7/2000 Newman et al. ..... 166/381
6,089,323 A 7/2000 Newman et al. ..... 166/381
6,119,772 A 9/2000 Pruet ..... 166/81.1
6,148,664 A 11/2000 Baird ..... 73/152.38
6,158,531 A 12/2000 Vail, III ..... 175/318
6,170,573 B1 1/2001 Brunet et al. ..... 166/153
6,172,010 B1 1/2001 Argillier et al. ..... 507/102
6,179,055 B1 1/2001 Sallwasser et al. ..... 166/254.2
6,182,776 B1 2/2001 Asberg ..... 175/300
6,189,621 B1 2/2001 Vail, III ..... 166/385
6,192,980 B1 2/2001 Tubel et al. ..... 166/65.1
6,196,336 B1 3/2001 Fincher et al. ..... 175/101
6,206,112 B1 3/2001 Dickinson, III et al. ..... 175/67
6,220,117 B1 4/2001 Butcher ..... 76/108.2
6,225,719 B1 5/2001 Hallundbaek ..... 310/90
6,234,257 B1 5/2001 Ciglenec et al. ..... 175/50
6,257,332 B1 7/2001 Vidrine et al. ..... 166/250.15
6,263,987 B1 7/2001 Vail, III ..... 175/318
6,273,189 B1 8/2001 Gissler et al. ..... 166/241.1
6,296,066 B1 10/2001 Terry et al. ..... 175/92
6,311,792 B1 11/2001 Scott et al. ..... 175/162
6,315,051 B1 11/2001 Ayling ..... 166/380
6,325,148 B1 12/2001 Trahan et al. ..... 166/297
6,343,649 B1 2/2002 Beck et al. ..... 166/250.01
6,347,674 B1 2/2002 Bloom et al. ..... 175/51
6,354,373 B1 3/2002 Vercaemer et al. ..... 166/277
6,357,485 B2 3/2002 Quigley et al. ..... 138/125
6,359,569 B2 3/2002 Beck et al. ..... 340/856.3
6,371,203 B2 4/2002 Frank et al. ..... 166/207
6,374,924 B1 4/2002 Hanton et al. ..... 176/6
6,378,627 B1 4/2002 Tubel et al. ..... 175/24
6,378,630 B1 4/2002 Ritorto et al. ..... 175/173
6,378,633 B1 4/2002 Moore et al. ..... 175/325.5
6,397,946 B1 6/2002 Vail, III ..... 166/250.01
6,405,798 B1 6/2002 Barrett et al. ..... 166/250.01
6,408,943 B1 6/2002 Schultz et al. ..... 166/285
6,412,554 B1 7/2002 Allen et al. ..... 166/80.1
6,412,574 B1 7/2002 Wardley et al. ..... 175/7
6,419,014 B1 7/2002 Meek et al. ..... 166/255.2
6,419,033 B1 7/2002 Hahn et al. ..... 176/61
6,427,776 B1 8/2002 Hoffman et al. ..... 166/311
6,443,241 B1 9/2002 Juhasz et al. ..... 175/52
6,443,247 B1 9/2002 Wardley ..... 175/402
6,464,004 B1 10/2002 Crawford et al. ..... 166/250.01
6,484,818 B2 11/2002 Alft et al. ..... 175/45
6,497,280 B2 12/2002 Beck et al. ..... 166/250.07
6,509,301 B1 1/2003 Vollmer ..... 507/236
6,527,047 B1 3/2003 Pietras ..... 166/77.51
6,527,064 B1 3/2003 Hallundbaek ..... 175/320
6,536,520 B1 3/2003 Snider et al. ..... 166/78.1
6,536,522 B2 3/2003 Birckhead et al. ..... 166/250.15
6,536,993 B2 * 3/2003 Strong et al. ..... 405/228
6,538,576 B1 3/2003 Schultz et al. ..... 340/859.6
6,543,538 B2 4/2003 Tolman et al. ..... 166/284
6,543,552 B1 * 4/2003 Metcalfe et al. ..... 175/57
6,547,017 B1 4/2003 Vail, III ..... 175/379
6,554,064 B1 4/2003 Restarick et al. ..... 166/250.01

| | | | | |
|---|---|---|---|---|
| 6,591,471 | B1 | 7/2003 | Hollingsworth et al. | 29/407.09 |
| 6,702,040 | B1 * | 3/2004 | Sensenig | 175/23 |
| 2001/0000101 | A1 | 4/2001 | Lovato et al. | |
| 2001/0013412 | A1 | 8/2001 | Tubel | |
| 2001/0040054 | A1 | 11/2001 | Haugen et al. | |
| 2001/0042625 | A1 | 11/2001 | Appleton | |
| 2001/0047883 | A1 | 12/2001 | Hanton et al. | |
| 2002/0066556 | A1 | 6/2002 | Goode et al. | |
| 2002/0074127 | A1 | 6/2002 | Birckhead et al. | |
| 2002/0074132 | A1 | 6/2002 | Juhasz et al. | |
| 2002/0134555 | A1 | 9/2002 | Allen et al. | |
| 2002/0157829 | A1 | 10/2002 | Davis et al. | |
| 2002/0162690 | A1 | 11/2002 | Hanton et al. | |
| 2002/0189806 | A1 | 12/2002 | Davidson et al. | |
| 2002/0189863 | A1 | 12/2002 | Wardley | |
| 2003/0034177 | A1 | 2/2003 | Chitwood et al. | |
| 2003/0056991 | A1 | 3/2003 | Hahn et al. | |
| 2003/0070841 | A1 | 4/2003 | Merecka et al. | |
| 2003/0141111 | A1 * | 7/2003 | Pia | 175/57 |
| 2004/0069501 | A1 * | 4/2004 | Haugen et al. | 166/381 |

OTHER PUBLICATIONS

Tarr, et al., "Casing–while–Drilling: The Next Step Change In Well Construction," World Oil, Oct. 1999, pp. 34–40.

De Leon Mojarro, "Breaking A Paradigm: Drilling with Tubin Gas Wells," SPE Paper 40051, SPE Annual Technical Conference And Exhibition, Mar. 3–5, 1998, pp. 465–472.

De Leon Mojarro, "Drilling/Completing With Tubing Cuts Well Costs by 30%," World Oil, Jul. 1998, pp. 145–150.

Littleton, "Refined Slimhole Drilling Technology Renews Operator Interest," Petroleum Engineer International, Jun. 1992, pp. 19–26.

Anon, "Slim Holes Fat Savings," Journal of Petroleum Technology, Sep. 1992, pp. 816–819.

Anon, "Slim Holes, Slimmer Prospect," Journal of Petroleum Technology, Nov. 1995, pp. 949–952.

Vogt, et al., "Drilling Liner Technology For Depleted Reservoir," SPE Paper 36827, SPE Annual Technical Conference And Exhibition, Oct. 22–24, pp. 127–132.

Jafer, et al., "Discussion And Comparison Of Performance Of Horizontal Wells in Bouri Field," SPE Paper 36927, SPE Annual Technical Conference And Exhibition, Oct. 22–24, 1996, pp. 465–473.

Boykin, "The Role Of A Worldwide Drilling Organization And The Road To The Future," SPE/IADC Paper 37630, SPE/IADC Drilling Conference, Mar. 4–6, 1997, pp. 489–498.

Mojarro, et al., "Drilling/Completing With Tubing Cuts Well Costs by 30%," World Oil, Jul. 1998, pp. 145–150.

Sinor, et al., Rotary Liner Drilling For Depleted Reservoirs, IADC/SPE Paper 39399, IADC/SPE Drilling Conference, Mar. 3–6, 1998, pp. 1–13.

Editor, "Innovation Starts At The Top At Tesco," The American Oil & Gas Reporter, Apr., 1998, p. 65.

Tessari, et al., "Casing Drilling—A Revolutionary Approach To Reducing Well Costs," SPE/IADC Paper 52789, SPE/IADC Drilling Conference, Mar. 9–11, 1999, pp. 221–229.

Santos, et al., "Consequences And Relevance Of Drillstring Vibration On Wellbore Stability," SPE/IADC Paper 52820, SPE/IADC Drilling Conference, Mar. 9–11, 1999, pp. 25–31.

Silverman, "Novel Drilling Method—Casing Drilling Process Eliminates Tripping String," Petroleum Engineer International, Mar. 1999, p. 15.

Silverman, "Drilling Technology—Retractable Bit Eliminates Drill String Trips," Petroleum Engineering International, Apr. 1999, p. 15.

Laurent, et al., "A New Generation Drilling Rig: Hydraulically Powered And Computer Controlled," CADE/CAODC Paper 99–120, CADE/CAODC Spring Drilling Conference, Apr. 7 & 8, 1999, 14 pages.

Madell, et al., "Casing Drilling An Innovative Approach To Reducing Drilling Costs," CADE/CAODC Paper 99–121, CADE/CAODC Spring Drilling Conference, Apr. 7 & 8, 1999, pp. 1–12.

Tessari, et al., "Focus: Drilling With Casing Promises Major Benefits," Oil & Gas Journal, May 17, 1999, pp. 58–62.

Laurent, et al., "Hydraulic Rig Supports Casing Drilling," World Oil, Sep. 1999, pp. 61–68.

Perdue, et al., "Casing Technology Improves," Hart's E & P, Nov. 1999, pp. 135–136.

Warren, et al., "Casing Drilling Application Design Considerations," IADC/SPE Paper 59179, IADC/SPE Drilling Conference, Feb. 23–25, 2000 pp. 1–11.

Warren, et al., "Drilling Technology: Part 1—Casing Drilling With Directional Steering In The U.S. Gulf Of Mexico," Offshore, Jan. 2001, pp. 50–52.

Warren, et al., "Drilling Technology; Part II—Casing Drilling With Directional Steering In The Gulf Of Mexico," Offshore, Feb. 2001, pp. 40–42.

Shepard, et al., "Casing Drilling: An Emerging Technology," IADC/SPE Paper 67731, SPE/IADC Drilling Conference, Feb. 27–Mar. 1, 2001, pp. 1–13.

Editor, "Tesco Finishes Field Trial Program," Drilling Contractor, Mar./Apr. 2001, p. 53.

Warren, et al., "Casing Drilling Technology Moves To More Challenging Application," AADE Paper 01–NC–HO–32, AADE National Drilling Conference, Mar. 27–29, 2001, pp. 1–10.

Shephard, et al., "Casing Drilling: An Emerging Technology," SPE Drilling & Completion, Mar. 2002, pp. 4–14.

Shephard, et al., "Casing Drilling Successfully Applied In Southern Wyoming," World Oil, Jun. 2002, pp. 33–41.

Forest, et al., "Subsea Equipment For Deep Water Drilling Using Dual Gradient Mud System," SPE/IADC Drilling Conference, Amsterdam, The Netherlands, Feb. 27, 2001–Mar. 01, 2001, 8 pages.

World's First Drilling With Casing Operation From A Floating Drilling Unit, Sep. 2003, 1 page.

Fillippov, et al., "Expandable Tubular Solutions," SPE paper 56500, SPE Annual Technical Conference And Exhibition, Oct. 3–6, 1999, pp. 1–16.

Lohefer, et al., "Expandable Liner Hanger Provides Cost–Effective Alternative Solution," IADC/SPE Paper 59151, IADC/SPE Drilling Conference, Feb. 23–25, 2000, pp. 1–12.

Daigle, et al., "Expandable Tubulars: Field Examples Of Application In Well Cosntruction And Remediation," APE Paper 62958; SPE Annual Technical Conference And Exhibition, Oct. 1–4, 2000, pp. 1–14.

Dupal, et al., "Solid Expandable Tubular Technology—A Year Of Case Histories In The Drilling Environment," SPE/IADC Paper 67770; SP:E/IADC Drilling Conference, Feb. 27–Mar. 1, 2001, pp. 1–16.

Coronado, et al., "Development Of A One–Trip ECP Cement Inflation And Stage Cementing System For Open Hole Completions," IADC/SPE paper 39345, IADC/SPE Drilling Conference, Mar. 3–6, 1998, pp. 473–481.

Fuller, et al., "Innovative Way To Cement A Liner Utilizing A New Liner String Liner Cementing Process," IADC/SPE Paper 39349 IADC/SPE Drilling Conference, Mar. 3–6, 1998, pp. 501–504.
Coronado et al., "A One–Trip External–Casing–Packer Cement–Inflation And Stage–Cementing System," Journal Of Petroleum Technology, Aug. 1998, pp. 76–77.
Camesa, Inc., "Electromechanical Cable," Dec. 1998, pp. 1–32.
The Rochester Corporation, "Well Logging Cables," Jul. 1999, 9 pages.
Quigley, "Coiled Tubing And Its Applications," SPE Short Course, Houston, Texas, Oct. 3, 1999, 9 pages.
"World Oil's Coiled Tubing Handbook," Gulf Publishing Co., 1993, p. 3, p. 5, pp. 45–50.
Sas–Joworsky, et al., "Development Of Composite Coiled Tubing For Oilfield Services," SPE Paper 26536, SPE Annual Technical Conference And Exhibition, Oct. 3–6, 1993, pp. 1–15.
Hallundbaek, "Well Tractors For Highly Deviated And Horizontal Wells," SPE paper 028871, SPE European Petroleum Conference, Oct. 25–27, 1994, pp. 57–62.
Leising, et al., "Extending The Reach Of Coiled Tubing Drilling (thrusters, Equalizers And Tractors)," SPE/IADC Paper 37656, SPE/IADC Drilling Conference, Mar. 4–6, 1997, pp. 677–690.
Bayfiled, et al., "Burst And Collapse Of A Sealed Mutilateral Junction: Numerical Simulations," SPE/IADC Paper 52873, SPE/IADC Drilling Conference, Mar. 9–11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5–6, 2000, pp. 1–9.
Bullock, et al., "Using Expandable Solid Tubulars to Solve Well Construction Challenges In Deep Waters And Maturing Properties," IBP Paper 275 00, Rio Oil & Gas Conference, Oct. 16–19, 2000, pp. 1–4.
Cales, et al., Subsidence Remediation—Extending Well Life Through The Use Of Solid Expandable Casing Systems, AADE Paper 01–NC–HO–24, American Association Of Drilling Engineers, Mar. 2001 Conference, pp. 1–16.
McSapdden, et al., "Field Validation Of 3–Dimensional Drag Model For Tractor And Cable–Conveyed Well Intervention," SPE Paper 71560, SPE Annual Technical Conference And Exhibition, Sep. 30–Oct. 3, 2001, pp. 1–8.
Coats, et al., "The Hybrid Drilling Unite: An Overview of an Integrated Composite Coiled Tubing And Hydraulic Workover Drilling System," SPE Paper 74349, SPE International Petroleum Conference And Exhibition, Feb. 10–12, 2002, pp. 1–7.
Sander, et al., "Project Management And Technology Provide Enhanced Performance For Shallow Horizontal Wells," IADC/SPE Paper 74466, IADC/SPE Drilling Conference, Feb. 26–28, 2002, pp. 1–9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26–28, 2002, pp. 1–7.
Editor, "New Downhole Tractor Put To Work," World Oil, Jun. 2000, pp. 75–76.
Henderson, et al., "Cost Saving Benefits Of Using A Fully Bi–Directional Tractor System," SPE/Petroleum Society Of CIM Paper 65467, SPE/Petroleum Society Of CIM International Conference On Horizontal Well Technology, Nov. 6–8, 2000, pp. 1–3.
Editor, "Shell Runs Smart Robot Tractor," Hart's E & P, Oct. 2002, p. 28.
Galloway, "Rotary Drilling With Casing—A Field Proven Method Of Reducing Wellbore Cosntruction Cost," Paper WOCD–0306092, World Oil Casing Drilling Technical Conference, Mar. 6–7, 2003, pp. 1–7.
Evans, et al., "Development And Testing Of An Economical Casing Connection For Use in Drilling Operations," paper WOCD–0306–03, World Oil Casing Drilling Technical Conference, Mar. 6–7, 2003, pp. 1–10.
Fontenot, et al., "New Rig Design Enhances Casing Drilling Operations In Lobo Trend," paper WOCD–0306–04, World Oil Casing Drilling Technical Conference, Mar. 6–7, 2003, pp. 1–13.
McKay, et al., "New Developments In The Technology Of Drilling With Casing: Utilizing A Displaceable DrillShoe Tool," Paper WOCD–0306–05, World Oil Casing Drilling Technical Conference, Mar. 6–7, 2003, pp. 1–11.
Sutriono—Santos, et al., "Drilling With Casing Advances To Floating Drilling Unit With Surface BOP Employed," Paper WOCD–0307–01, World Oil Casing Drilling Technical Conference, Mar. 6–7, 2003, pp. 1–7.
Vincent, et al., "Linear And Casing Drilling—Case Histories And Technology," Paper WOCD–0307–02, World Oil Casing Drilling Technical Conference, Mar. 6–7, 2003, pp. 1–20.
Maute, "Electrical Logging: State–of–the Art," the Log Analyst, May–Jun. 1992, pp. 206–227.

* cited by examiner

APPARATUS AND METHOD FOR DRILLING WITH CASING

BACKGROUND OF THE INVENTION

1. Field of the Invention

The present invention relates to wellbore completion. More particularly, the invention relates to effectively increasing the carrying capacity of the circulating fluid without damaging wellbore formations. More particularly still, the invention relates to removing cuttings in a wellbore during a drilling operation.

2. Description of the Related Art

In the drilling of oil and gas wells, a wellbore is formed using a drill bit that is urged downwardly at a lower end of a drill string. After drilling a predetermined depth, the drill string and bit are removed, and the wellbore is lined with a string of casing with a specific diameter. An annular area is thus defined between the outside of the casing and the earth formation. This annular area is filled with cement to permanently set the casing in the wellbore and to facilitate the isolation of production zones and fluids at different depths within the wellbore.

It is common to employ more than one string of casing in a wellbore. In this respect, a first string of casing is set in the wellbore when the well is drilled to a first designated depth. The well is then drilled to a second designated depth and thereafter lined with a string of casing with a smaller diameter than the first string of casing. This process is repeated until the desired well depth is obtained, each additional string of casing resulting in a smaller diameter than the one above it. The reduction in the diameter reduces the cross-sectional area in which circulating fluid may travel.

Typically, fluid is circulated throughout the wellbore during the drilling operation to cool a rotating bit and remove wellbore cuttings. The fluid is generally pumped from the surface of the wellbore through the drill string to the rotating bit. Thereafter, the fluid is circulated through an annulus formed between the drill string and the string of casing and subsequently returned to the surface to be disposed of or reused. As the fluid travels up the wellbore, the cross-sectional area of the fluid path increases as each larger diameter string of casing is encountered. For example, the fluid initially travels up an annulus formed between the drill string and the newly formed wellbore at a high annular velocity due to small annular clearance. However, as the fluid travels the portion of the wellbore that was previously lined with casing, the enlarged cross-sectional area defined by the larger diameter casing results in a larger annular clearance between the drill string and the cased wellbore, thereby reducing the annular velocity of the fluid. This reduction in annular velocity decreases the overall carrying capacity of the fluid, resulting in the drill cuttings dropping out of the fluid flow and settling somewhere in the wellbore. This settling of the drill cuttings and debris can cause a number of difficulties to subsequent downhole operations. For example, it is well known that the setting of tools against a casing wall is hampered by the presence of debris on the wall.

Several methods have been developed to prevent the settling of the drill cuttings and debris by overcoming the deficiency of the carrying capacity of the circulating fluid. One such method is used in a deepwater application where the increased diameter of the drilling riser results in a lower annular velocity in the riser system. Generally, fluid from the surface of the floating vessel is injected into a lower portion of the riser system through a flow line disposed on the outside of the riser pipe. This method is often referred to as "charging the riser". This method effectively increases the annular velocity and carrying capacity of the circulating fluid to assist in wellbore cleaning. However, this method is not practical for downhole operations.

Another method to prevent the settling of the drill cuttings and debris is by simply increasing the flow rate of the circulating fluid over the entire wellbore interval to compensate for the lower annular velocity in the larger annular areas. This method increases the annular velocity in the larger annular areas, thereby minimizing the amount of settling of the drill cuttings and debris. However, the higher annular velocity also increases the potential of wellbore erosion and increases the equivalent circulating density, which deals with the friction forces brought about by the circulation of the fluid. Neither effect is desirable, but this method is often used by operators to compensate for the poor downhole cleaning due to lower annular velocity of the circulating fluid.

Potential problems associated with flow rate and the velocity of return fluid while drilling are increased when the wellbore is formed by a technique known as "drilling with casing". Drilling with casing is a method where a drill bit is attached to the same string of tubulars that will line the wellbore. In other words, rather than run a drill bit on smaller diameter drill string, the bit is run at the end of larger diameter tubing or casing that will remain in the wellbore and be cemented therein. The bit is typically removed in sections or destroyed by drilling the next section of the wellbore. The advantages of drilling with casing are obvious. Because the same string of tubulars transports the bit as lines the wellbore, no separate trip into the wellbore is necessary between the forming of the wellbore and the lining of the wellbore.

Drilling with casing is especially useful in certain situations where an operator wants to drill and line a wellbore as quickly as possible to minimize the time the wellbore remains unlined and subject to collapse or to the effects of pressure anomalies. For example, when forming a subsea wellbore, the initial length of wellbore extending from the ocean floor is much more subject to cave in or collapse due to soft formations as the subsequent sections of wellbore. Sections of a wellbore that intersect areas of high pressure can lead to damage of the wellbore between the time the wellbore is formed and when it is lined. An area of exceptionally low pressure will drain expensive circulating fluid from the wellbore between the time it is intersected and when the wellbore is lined.

In each of these instances, the problems can be eliminated or their effects reduced by drilling with casing. However, drilling with casing results in a smaller annular clearance between the outer diameter of the casing and the inner diameter of the newly formed wellbore. This small annular clearance causes the circulating fluid to travel through the annular area at a high annular velocity, resulting in a higher potential of wellbore erosion compared to a conventional drilling operation.

A need therefore exists for an apparatus and a method for preventing settling of drill cuttings and other debris in the wellbore during a drilling operation. There is a further need for an apparatus and a method that will effectively increase the carrying capacity of the circulating fluid without damaging wellbore formations. There is yet a further need for a cost-effective method for cleaning out a wellbore while drilling with casing.

SUMMARY OF THE INVENTION

The present invention generally relates to a method and an apparatus for drilling with casing. In one aspect, a method of drilling a wellbore with casing is provided, including placing a string of casing with a drill bit at the lower end thereof into a previously formed wellbore and urging the string of casing axially downward to form a new section of wellbore. The method further includes pumping fluid through the string of casing into an annulus formed between the casing string and the new section of wellbore. The method also includes diverting a portion of the fluid into an upper annulus in the previously formed wellbore.

In another aspect, a method of drilling with casing to form a wellbore is provided. The method includes placing a casing string with a drill bit at the lower end thereof into a previously formed wellbore and urging the casing string axially downward to form a new section of wellbore. The method further includes pumping fluid through the casing string into an annulus formed between the casing string and the new section of wellbore. Additionally, the method includes diverting a portion of the fluid into an upper annulus in the previously formed wellbore from a flow path in a run-in string of tubulars disposed above the casing string.

In yet another aspect, an apparatus for forming a wellbore is provided. The apparatus comprises a casing string with a drill bit disposed at an end thereof and a fluid bypass formed at least partially within the casing string for diverting a portion of fluid from a first to a second location within the casing string as the wellbore is formed.

In another aspect, a method of casing a wellbore while drilling the wellbore is provided, including flowing a fluid through a drilling apparatus. The method also includes operating the drilling apparatus to drill the wellbore, the drilling apparatus comprising a drill bit, a wellbore casing, and a fluid bypass. The method further includes diverting a portion of the flowing fluid with the fluid bypass and placing at least a portion of the wellbore casing in the drilled wellbore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention relates to apparatus and methods for effectively increasing the carrying capacity of the circulating fluid without damaging wellbore formations. The invention will be described in relation to a number of embodiments and is not limited to any one embodiment shown or described.

Figure 1:
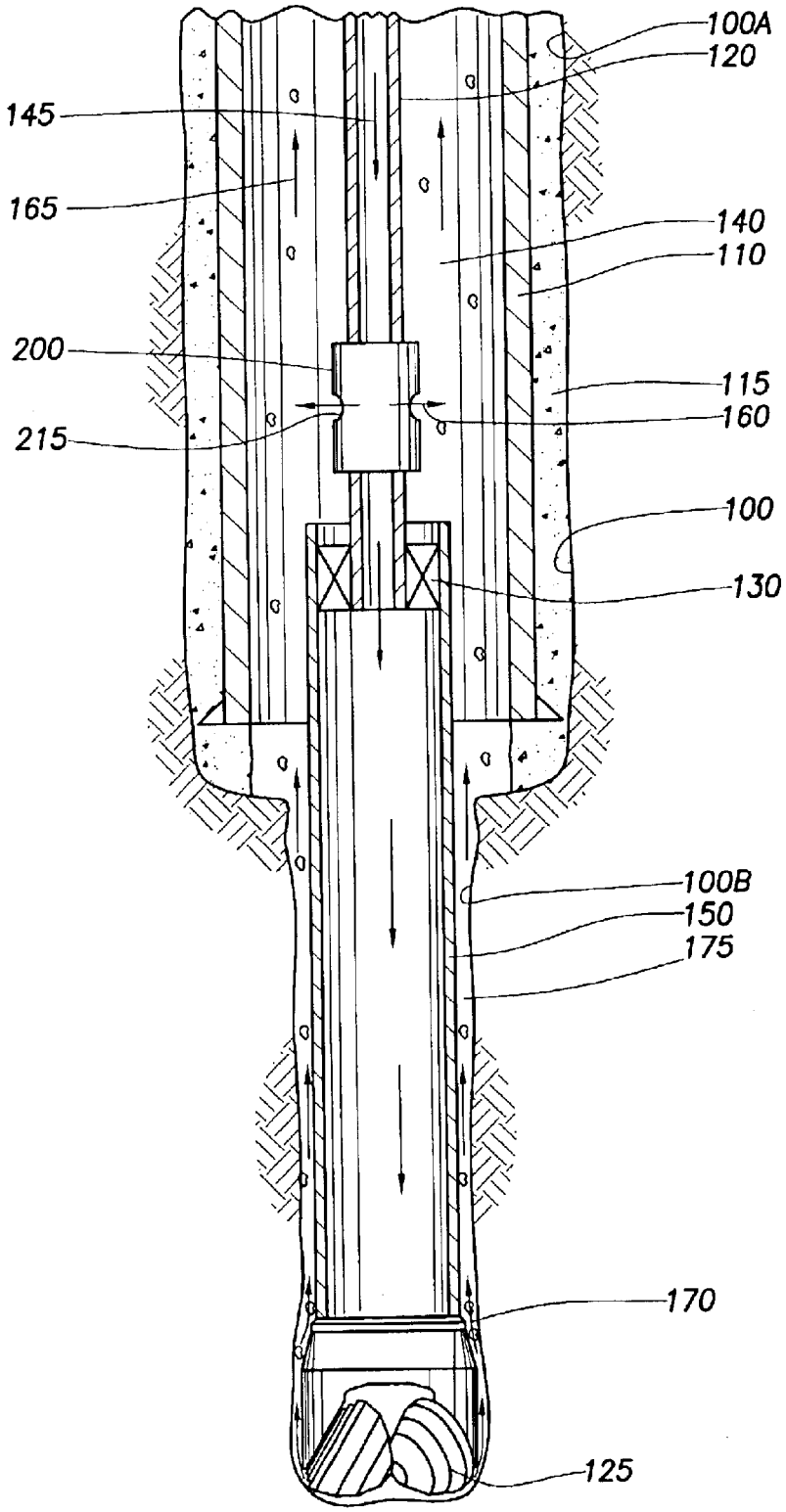
FIG. 1 is a cross-sectional view illustrating a flow apparatus disposed at the lower end of the run-in string.

FIG. 1 is a section view of a wellbore 100. For clarity, the wellbore 100 is divided into an upper wellbore 100A and a lower wellbore 100B. The upper wellbore 100A is lined with casing 110 and an annular area between the casing 110 and the upper wellbore 100A is filled with cement 115 to strengthen and isolate the upper wellbore 100A from the surrounding earth. At a lower end of the upper wellbore 100A, the casing 110 terminates and the subsequent lower wellbore 100B is formed. Coaxially disposed in the wellbore 100 is a work string 120 made up of tubulars with a running tool 130 disposed at a lower end thereof. Generally, the running tool 130 is used in the placement or setting of downhole equipment and may be retrieved after the operation or setting process. The running tool 130 in this invention is used to connect the work string 120 to a casing string 150 and subsequently release the casing string 150 after the lower wellbore 100B is formed and the casing string 150 is secured.

As illustrated, a drill bit 125 is disposed at the lower end of the casing string 150. Generally, the lower wellbore 100B is formed as the drill bit 125 is rotated and urged axially downward. The drill bit 125 may be rotated by a mud motor (not shown) located in the casing string 150 proximate the drill bit 125 or by rotating the casing string 150. In either case, the drill bit 125 is attached to the casing string 150 that will subsequently remain downhole to line the lower wellbore 100B, therefore there is no opportunity to retrieve the drill bit 125 in the conventional manner. In this respect, drill bits made of drillable material, two-piece drill bits or bits integrally formed at the end of casing string are typically used.

Circulating fluid or "mud" is circulated down the work string 120, as illustrated with arrow 145, through the casing string 150 and exits the drill bit 125. The fluid typically provides lubrication for the drill bit 125 as the lower wellbore 100B is formed. Thereafter, the fluid combines with other wellbore fluid to transport cuttings and other wellbore debris out of the wellbore 100. As illustrated with arrow 170, the fluid initially travels upward through a smaller annular area 175 formed between the outer diameter of the casing string 150 and the lower wellbore 100B. Generally, the velocity of the fluid is inversely proportional to the annular area defining the fluid path. In other words, if the fluid path has a large annular area then the velocity of the fluid is low. Conversely, if the fluid path has a small annular area then the velocity of the fluid is high. Therefore, the fluid traveling through the smaller annular area 175 has a high annular velocity.

Subsequently, the fluid travels up a larger annular area 140 formed between the work string 120 and the inside diameter of the casing 110 in the upper wellbore 100A as illustrated by arrow 165. As the fluid transitions from the smaller annular area 175 to the larger annular area 140 the annular velocity of the fluid decreases. Similarly, as the annular velocity decreases, so does the carrying capacity of the fluid resulting in the potential settling of drill cuttings and wellbore debris on or around the upper end of the casing string 150. To increase the annular velocity, a flow apparatus 200 is used to inject fluid into the larger annular area 140.

Disposed on the work string 120 and shown schematically in FIG. 1 is the flow apparatus 200. Although FIG. 1 shows one flow apparatus 200 attached to the work string 120, any number of flow apparatus may be attached to the work string 120 or the casing string 150 in accordance with the present invention. The purpose of the flow apparatus 200 is to divert a portion of the circulating fluid into the larger annular area 140 to increase the annular velocity of the fluid traveling up the wellbore 100. It is to be understood, however, that the flow apparatus 200 may be disposed on the work string 120 at any location, such as adjacent the casing string 150 as shown on FIG. 1 or further up the work string 120. Furthermore, the flow apparatus 200 may be disposed in the casing string 150 or below the casing string 150 providing the lower wellbore 100B would not be eroded or over pressurized by the circulating fluid.

One or more ports 215 in the flow apparatus 200 may be modified to control the percentage of flow that passes to drill bit 125 and the percentage of flow that is diverted to the larger annular area 140. The ports 215 may also be oriented in an upward direction to direct the fluid flow up the larger annular area 140, thereby encouraging the drill cuttings and debris out of the wellbore 100. Furthermore, the ports 215 may be systematically opened and closed as required to modify the circulation system or to allow operation of a pressure controlled downhole device.

The flow apparatus 200 is arranged to divert a predetermined amount of circulating fluid from the flow path down the work string 120. The diverted flow, as illustrated by arrow 160, is subsequently combined with the fluid traveling upward through the larger annular area 140. In this manner, the annular velocity of fluid in the larger annular area 140 is increased which directly increases the carrying capacity of the fluid, thereby allowing the cuttings and debris to be effectively removed from the wellbore 100. At the same time, the annular velocity of the fluid traveling up the smaller annular area 175 is lowered as the amount of fluid exiting the drill bit 125 is reduced. In this respect, the annular velocity of the fluid traveling down the work string 120 is used to effectively transport drill cutting and other debris up the larger annular area 140 while minimizing erosion in the lower wellbore 100B by the fluid traveling up the annular area 175.

Figure 2A:
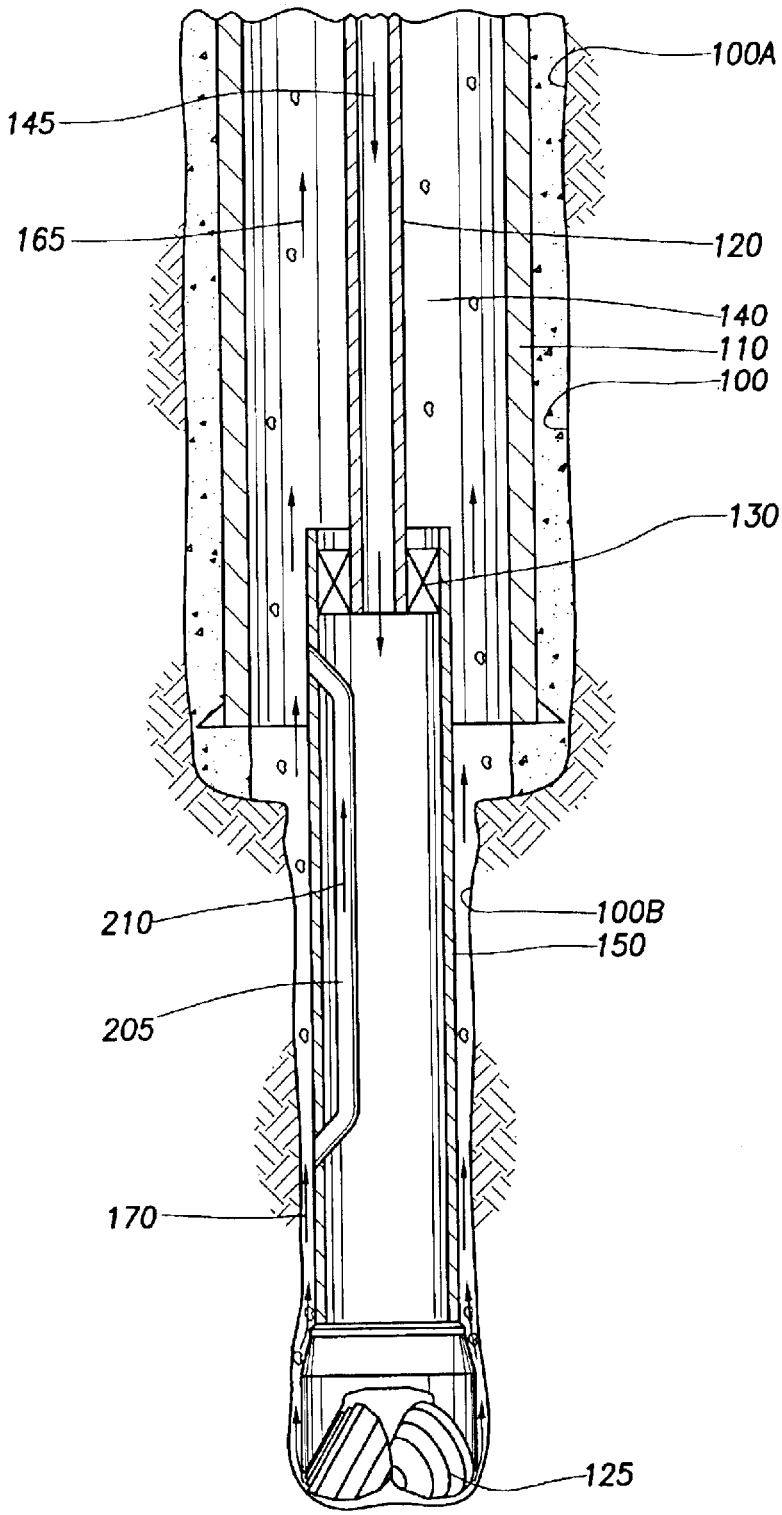
FIG. 2A is a cross-sectional view illustrating an auxiliary flow tube partially formed in a casing string.

FIG. 2A is a cross-sectional view illustrating an auxiliary flow tube 205 partially formed in the casing string 150. As illustrated with arrow 145, circulating fluid is circulated down the work string 120 through the casing string 150 and exits the drill bit 125 to provide lubrication for the drill bit 125 as the lower wellbore 100B is formed. Thereafter, the fluid combines with other wellbore fluid to transport cuttings and other wellbore debris out of the wellbore 100. As illustrated with arrow 170, the fluid initially travels at a high annular velocity upward through a portion of the smaller annular area 175 formed between the outer diameter of the casing string 150 and the lower wellbore 100B. However, at a predetermined distance, a portion of the fluid, as illustrated by arrow 210, is redirected to the auxiliary flow tube 205 disposed in the casing string 150. Furthermore, the auxiliary flow tube 205 may be systematically opened and closed as required to modify the circulation system or to allow operation of a pressure controlled downhole device.

The auxiliary flow tube 205 is constructed and arranged to remove and redirect a predetermined amount of high annular velocity fluid traveling up the smaller annular area 175. In other words, the auxiliary flow tube 205 increases the annular velocity of the fluid traveling up the larger annular area 140 by diverting a portion of high annular velocity fluid in the smaller annular area 175 to the larger annular area 140. Although FIG. 2A shows one auxiliary flow tube 205 attached to the casing string 150, any number of auxiliary flow tubes may be attached to the casing string 150 in accordance with the present invention. Additionally, the auxiliary flow tube 205 may be disposed on the casing string 150 at any location, such as adjacent the drill bit 125 as shown on FIG. 2A or further up the casing string 150, so long as the high annular velocity fluid in the smaller annular area 175 is transported to the larger annular area 140. In this respect, the annular velocity of fluid in the larger annular area 140 is increased which directly increases the carrying capacity of the fluid allowing the cuttings and debris to be effectively removed from the wellbore 100. At the same time, the annular velocity of the fluid traveling up the smaller annular area 175 is reduced, thereby minimizing erosion or pressure damage in the lower wellbore 100B by the fluid traveling up the annular area 175.

Figure 2B:
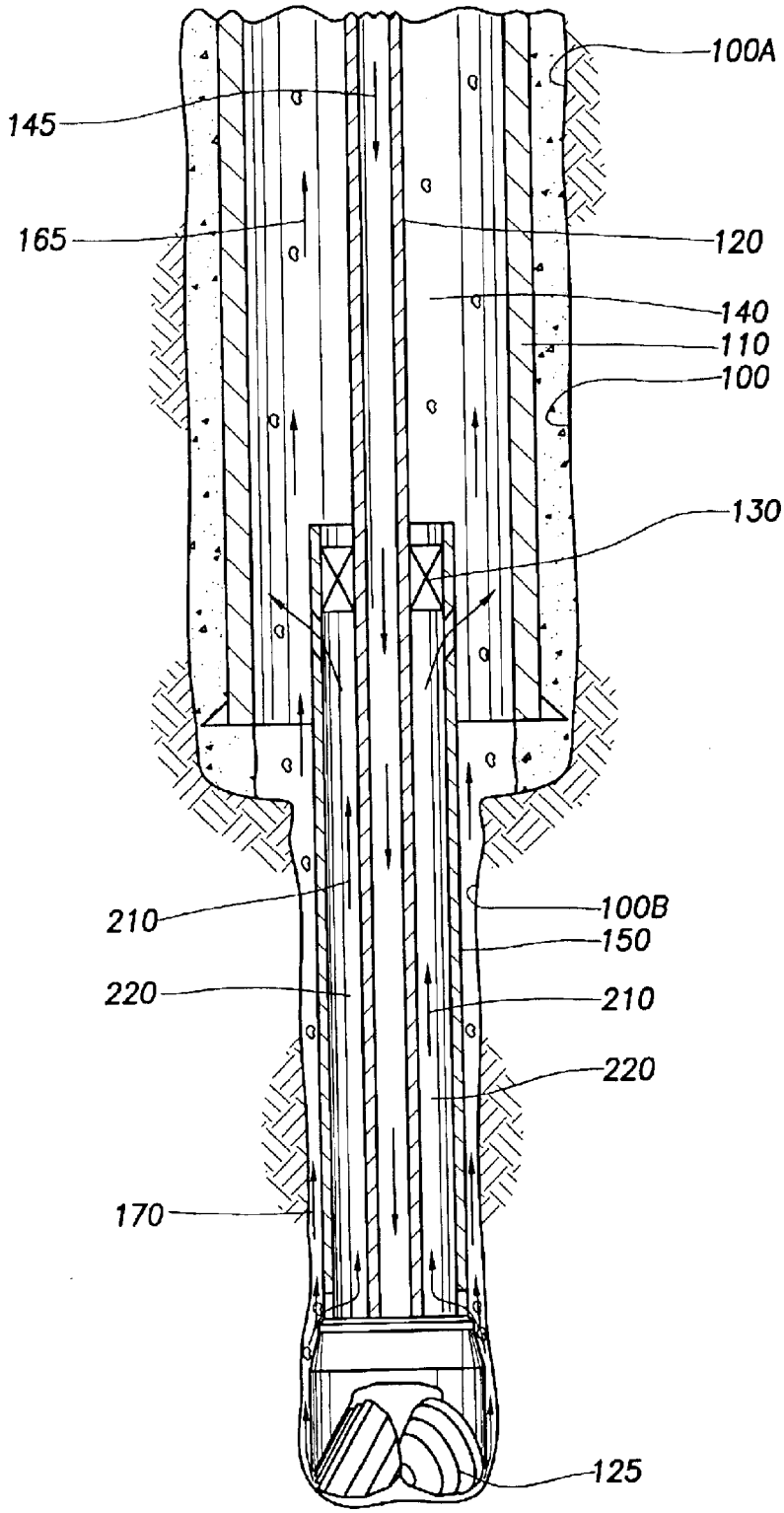
FIG. 2B is a cross-sectional view illustrating a main flow tube formed in the casing string.

FIG. 2B is a cross-sectional view illustrating a main flow tube 220 formed in the casing string 150. As illustrated with arrow 145, circulating fluid is circulated down the work string 120 through the casing string 150 and exits the drill bit 125 to provide lubrication as the lower wellbore 100B is formed. Thereafter, the fluid combines with other wellbore fluid to transport cuttings and other wellbore debris out of the wellbore 100. Subsequently, as illustrated with arrow 170, a first portion of the fluid at a high annular velocity travels upward through a portion of the smaller annular area 175 formed between the outer diameter of the casing string 150 and the lower wellbore 100B. A second portion of fluid, as illustrated by arrow 210, travels through the main flow tube 220 to the larger annular area 140. In the same manner as discussed in a previous paragraph, the annular velocity of fluid in the larger annular area 140 is increased and the annular velocity of the fluid in the smaller annular area 175 is reduced, thereby minimizing erosion or pressure damage in the lower wellbore 100B by the fluid traveling up the annular area 175.

Figure 3:
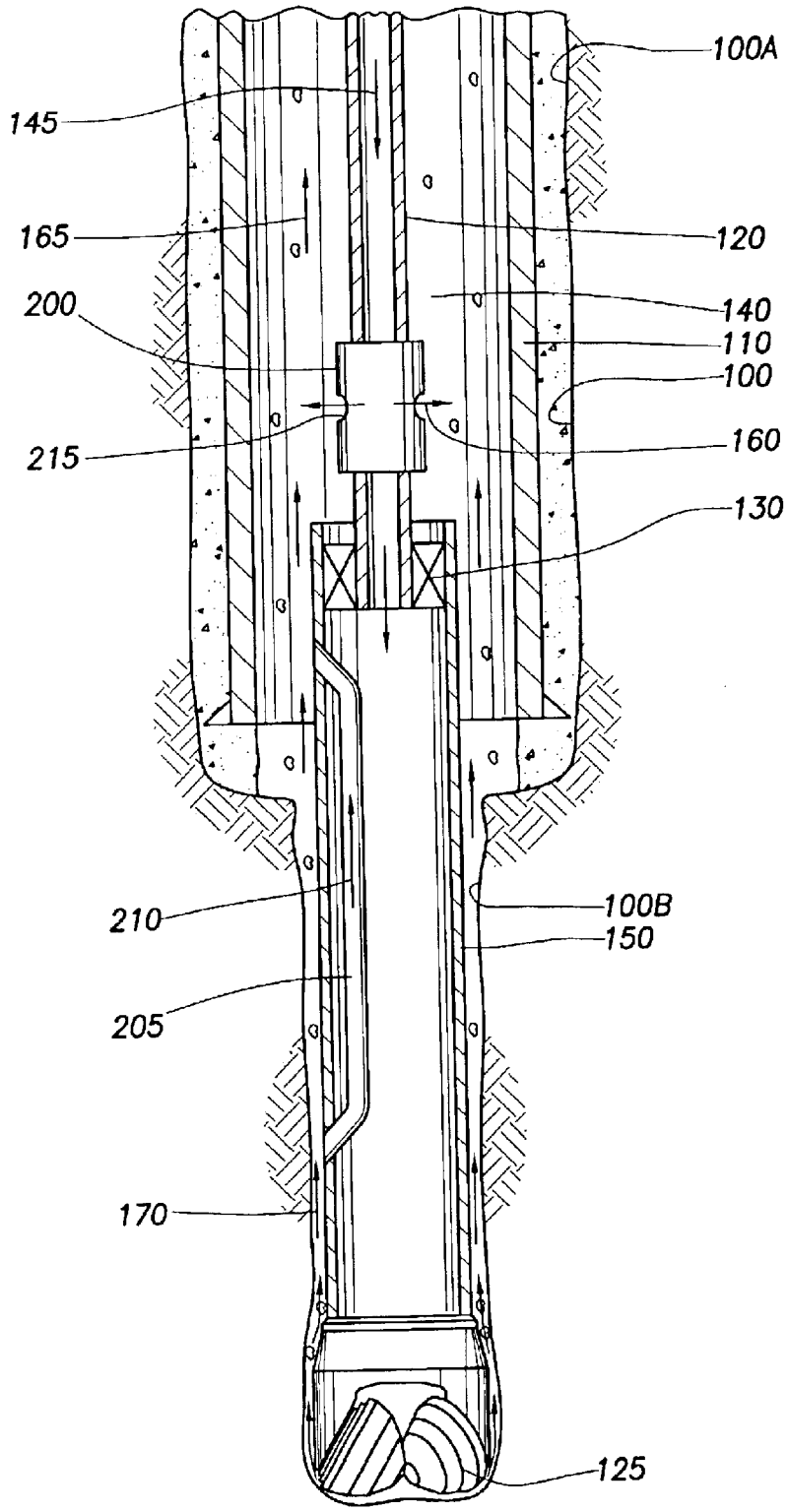
FIG. 3 is a cross-sectional view illustrating the flow apparatus and auxiliary flow tube in accordance with the present invention.

FIG. 3 is a cross-sectional view illustrating the flow apparatus 200 and auxiliary flow tube 205 in accordance with the present invention. In the embodiment shown, the flow apparatus 200 is disposed on the work string 120 and the auxiliary flow tube 205 is disposed on the casing string 150. It is to be understood, however, that the flow apparatus 200 may be disposed on the work string 120 at any location, such as adjacent the casing string 150 as shown on FIG. 3 or further up the work string 120. Furthermore, the flow apparatus 200 may be disposed in the casing string 150 or below the casing string 150 providing the lower wellbore 100B would not be eroded or over pressurized by the fluid exiting the flow control apparatus 200. In the same manner, the auxiliary flow tube 205 may be positioned at any location on the casing string 150, so long as the high annular velocity fluid in the smaller annular area 175 is transported to the larger annular area 140. Additionally, it is within the scope of this invention to employ a number of flow apparatus or auxiliary flow tubes.

Similar to the other embodiments, fluid is circulated down the work string 120 through the casing string 150 to lubricate and cool the drill bit 125 as the lower wellbore 100B is formed. Thereafter, the fluid combines with other wellbore fluid to transport cuttings and other wellbore debris out of the wellbore 100. However, in the embodiment illustrated in FIG. 3, a portion of fluid pumped through the work string 120 may be diverted through the flow apparatus 200 into the larger annular area 140 at a predetermined point above the casing string 150. At the same time, a portion of high velocity fluid traveling up the smaller annular area 175 may be communicated through the auxiliary flow tube 205 into the larger annular area 140 at a predetermined point below the upper end of the casing string 150.

The operator may selectively open and close the flow apparatus 200 or the auxiliary flow tube 205 individually or collectively to modify the circulation system. For example, an operator may completely open the flow apparatus 200 and partially close the auxiliary flow tube 205, thereby injecting circulating fluid in an upper portion of the larger annular area 140 while maintaining a high annular velocity fluid traveling up the smaller annular area 175. In the same fashion, the operator may partially close the flow apparatus 200 and completely open the auxiliary flow tube 205, thereby injecting high velocity fluid to a lower portion of the larger annular area 140 while allowing minimal circulating fluid into the upper portion of the larger annular area 140. There are numerous combinations of selectively opening and closing the flow apparatus 200 or the auxiliary flow tube 205 to achieve the desired modification to the circulation system. Additionally, the flow apparatus 200 and the auxiliary flow tube 205 may be hydraulically opened or closed by control lines (not shown) or by other methods well known in the art.

In operation, a work string, a running tool and a casing string with a drill bit disposed at a lower end thereof are inserted into a wellhead and coaxially disposed in an upper wellbore. Subsequently, the casing string and the drill bit are rotated and urged axially downward to form the lower wellbore. At the same time, circulating fluid or "mud" is circulated down the work string through the casing string and exits the drill bit. The fluid typically provides lubrication for the rotating drill bit as the lower wellbore is formed. Thereafter, the fluid combines with other wellbore fluid to transport cuttings and other wellbore debris out of the wellbore. The fluid initially travels upward through a smaller annular area formed between the outer diameter of the casing string and the lower wellbore. Subsequently, the fluid travels up a larger annular area formed between the work string and the inside diameter of the casing lining the upper wellbore. As the fluid transitions from the smaller annular area to the larger annular area the annular velocity of the fluid decreases. Similarly, as the annular velocity decreases, so does the carrying capacity of the fluid resulting in the potential settling of drill cuttings and wellbore debris on or around the upper end of the casing string 150.

A flow apparatus and an auxiliary flow tube are used to increase the annular velocity of the fluid traveling up the larger annular area by injecting high velocity fluid directly into the larger annular area. Generally, the flow apparatus is disposed on the work string to redirect circulating fluid flowing through the work string into an upper portion of the larger annular area. At the same time, the auxiliary flow tube is disposed on the casing string to redirect high velocity fluid traveling up the smaller annular area in a lower portion of the larger annular area. Both the flow apparatus and the auxiliary flow tube may be may selectively opened and closed individually or collectively to modify the circulation system. In this respect, if fluid is primarily required in the upper portion of the larger annular area then the flow apparatus may be completely opened and the auxiliary flow tube is closed. On the other hand, if fluid is primarily required in the lower portion of the larger annular area then the flow apparatus is closed and the auxiliary flow tube is opened. In this manner, the circulation system may be modified to increase the carrying capacity of the circulating fluid without damaging the wellbore formations.

While the foregoing is directed to embodiments of the present invention, other and further embodiments of the invention may be devised without departing from the basic scope thereof, and the scope thereof is determined by the claims that follow.

What is claimed is:

1. A method of drilling a wellbore with casing, comprising:

placing a string of casing with a drill bit at the lower end thereof into a previously formed wellbore;

urging the string of casing axially downward to form a new section of wellbore;

pumping fluid through the string of casing into an annulus formed between the casing string and the new section of wellbore; and diverting a portion of the fluid from the annulus into an upper annulus in the previously formed wellbore.

2. The method of claim 1, wherein the annulus is smaller in diameter than the upper annulus.

3. The method of claim 1, wherein the fluid travels upward in the annulus at a higher velocity than the fluid travels in the upper annulus.

4. The method of claim 1, wherein the previously formed wellbore is at least partially lined with casing.

5. The method of claim 1, wherein the fluid carries wellbore cuttings upwards towards a surface of the wellbore.

6. The method of claim 1, further including rotating the string of casing as the string of casing is urged axially downward.

7. The method of claim 1, wherein the fluid is diverted into the upper annulus from a flow path in a run-in string of tubulars disposed above the string of casing.

8. The method of claim 7, wherein the flow path is selectively opened and closed to control the amount of fluid flowing through the flow path.

9. The method of claim 1, wherein the fluid is diverted into the upper annulus via an independent fluid path.

10. The method of claim 9, wherein the independent fluid path is formed at least partially within the string of casing.

11. The method of claim 9, wherein the independent fluid path is selectively opened and closed to control the amount of fluid flowing through the independent fluid path.

12. The method of claim 1, wherein the fluid is diverted into the upper annulus via a flow apparatus disposed in the string of casing.

13. The method of claim 12, wherein the flow apparatus includes one or more ports that may be selectively opened and closed to control the amount of fluid flowing through the flow apparatus.

14. The method of claim 13, wherein the ports are positioned in an upward direction to direct the flow of fluid upward into the upper annulus.

15. A method of drilling with casing to form a wellbore, comprising:

placing a casing string with a drill bit at the lower end thereof into a previously formed wellbore;

urging the easing string axially downward to form a new section of wellbore;

pumping fluid through the casing string into an annulus formed between the casing string and the new section of wellbore; and diverting a portion of the fluid into an upper annulus in the previously formed wellbore from a flow path in a run-in string of tubulars disposed above the casing string.

16. The method of claim 15, wherein the annulus is smaller in diameter than the upper annulus.

17. The method of claim 15, wherein the fluid travels upward in the annulus at a higher velocity than the fluid travels in the upper annulus.

18. The method of claim 15, wherein the previously formed wellbore is at least partially lined with casing.

19. The method of claim 15, further including rotating the string of casing as the string of casing is urged axially downward.

20. The method of claim 15, further including diverting a second portion of fluid into an upper annulus in the previously formed wellbore from an independent fluid path formed at least partially within the casing string.

21. The method of claim 15, wherein the fluid carries wellbore cuttings upwards towards a surface of the wellbore.

22. The method of claim 15, wherein the independent fluid path is selectively opened and closed to control the amount of fluid flowing through the independent fluid path.

23. The method of claim 15, wherein a flow apparatus is disposed in the casing string.

24. The method of claim 23, wherein the flow apparatus includes one or more ports that may be selectively opened and closed to control the amount of fluid flowing through the flow apparatus into the upper annulus.

25. An apparatus for forming a wellbore, comprising:

a casing string with a drill bit disposed at an end thereof; and a working string coupled to the casing string;

a fluid bypass disposed above the drill bit and operatively connected to the casing string for diverting a portion of fluid flowing towards the drill bit from an interior portion of the working string to an exterior portion of the working string.

26. The apparatus of claim 25, wherein the fluid bypass is selectively opened and closed to control the amount of fluid flowing through the fluid bypass.

27. The apparatus of claim 25, further including a flow apparatus disposed in the casing string.

28. The method of claim 27, wherein the flow apparatus includes one or more ports that may be selectively opened and closed to control the amount of fluid flowing through the flow apparatus.

29. The apparatus of claim 25, wherein the fluid bypass is formed at least partially within the casing string.

30. An apparatus for forming a wellbore, comprising:

a casing string with a drill bit disposed at an end thereof; and a fluid bypass operatively connected to the casing string for diverting a portion of fluid from a first to a second location within the wellbore as the wellbore is formed, wherein the fluid bypass is selectively opened and closed to control the amount of fluid flowing through the fluid bypass.

31. An apparatus for forming a wellbore, comprising:

a casing string with a drill bit disposed at an end thereof;

a fluid bypass operatively connected to the casing string for diverting a portion of fluid from a first to a second location within the wellbore as the wellbore is formed;

a flow apparatus disposed in the casing string, wherein the flow apparatus includes one or more ports that may be selectively opened and closed to control the amount of fluid flowing through the flow apparatus.

* * * * *